US010780696B2

(12) United States Patent
Chen et al.

(10) Patent No.: US 10,780,696 B2
(45) **Date of Patent: *Sep. 22, 2020**

(54) PRINTBARS AND METHODS OF FORMING PRINTBARS

(71) Applicant: Hewlett-Packard Development Company, L.P., Fort Collins, CO (US)

(72) Inventors: Chien-Hua Chen, Corvallis, OR (US); Michael W. Cumbie, Albany, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/541,410

(22) Filed: Aug. 15, 2019

(65) Prior Publication Data

US 2020/0023641 A1 Jan. 23, 2020

Related U.S. Application Data

(62) Division of application No. 15/113,533, filed as application No. PCT/US2014/013317 on Jan. 28, 2014, now Pat. No. 10,421,274.

(51) Int. Cl.
*B41J 2/14* (2006.01)
*B41J 2/16* (2006.01)

(52) U.S. Cl.
CPC ..... *B41J 2/1433* (2013.01); *B41J 2/1603* (2013.01); *B41J 2/1623* (2013.01); *B41J 2/1628* (2013.01); *B41J 2/1629* (2013.01); *B41J 2/1632* (2013.01); *B41J 2/1637* (2013.01); *B41J 2002/14491* (2013.01)

(58) Field of Classification Search
None
See application file for complete search history.

(56) References Cited

U.S. PATENT DOCUMENTS 4,528,577 A 7/1985 Cloutier
6,273,557 B1 8/2001 Milligan
(Continued)

FOREIGN PATENT DOCUMENTS

CN 1229727 9/1999
CN 1490160 4/2004
(Continued)

OTHER PUBLICATIONS

Chen, et al. "Printbar and Method of Forming Same", Related PCT Application No. PCT/US2013/060828, Filed Sep. 20, 2013, 21 pages.

*Primary Examiner* — Alejandro Valencia
(74) *Attorney, Agent, or Firm* — Rathe Lindenbaum LLP

(57) ABSTRACT

A method of forming a printbar module may include providing a printed circuit board (PCB) having a recess extending partially through the PCB and a dam surrounding the recess. An adhesive material may be applied to the recess and a printhead die sliver may be positioned in the recess. The printhead die sliver may be bonded with the PCB and the printhead die sliver and the PCB may be encapsulated with a molding compound. In response to encapsulating, a slot, extending through the PCB and the adhesive material may be formed, wherein the slot is in fluidic communication with fluid feed holes of the printhead die sliver to provide direct fluidic communication without fan-out.

20 Claims, 6 Drawing Sheets

(56) References Cited

U.S. PATENT DOCUMENTS

| | | | |
|---|---|---|---|
| 6,379,988 | B1 | 4/2002 | Peterson et al. |
| 6,554,399 | B2 | 4/2003 | Wong |
| 6,821,819 | B1 | 11/2004 | Benavides et al. |
| 7,490,924 | B2 | 2/2009 | Haluzak et al. |
| 8,623,674 | B2 | 1/2014 | Uyama |
| 10,226,926 | B2 * | 3/2019 | Chen ..... B41J 2/1603 |
| 2002/0118254 | A1 | 8/2002 | Wong |
| 2002/0191054 | A1 | 12/2002 | Liu |
| 2003/0137560 | A1 | 7/2003 | Lebens et al. |
| 2003/0186474 | A1 | 10/2003 | Haluzak et al. |
| 2006/0027937 | A1 | 2/2006 | Benson |
| 2006/0264055 | A1 | 11/2006 | Leith et al. |
| 2008/0259125 | A1 | 10/2008 | Haluzak |
| 2009/0009559 | A1 | 1/2009 | Jindai et al. |
| 2009/0225131 | A1 | 9/2009 | Chen et al. |
| 2010/0079542 | A1 | 4/2010 | Ciminelli et al. |
| 2010/0132874 | A1 | 6/2010 | Anderson et al. |
| 2011/0037808 | A1 | 2/2011 | Ciminelli et al. |
| 2011/0292124 | A1 | 12/2011 | Anderson et al. |
| 2011/0298868 | A1 | 12/2011 | Fileder et al. |
| 2013/0193105 | A1 | 8/2013 | Ciminelli et al. |
| 2013/0194349 | A1 | 8/2013 | Ciminelli et al. |
| 2016/0001558 | A1 | 1/2016 | Chen et al. |
| 2016/0016404 | A1 | 1/2016 | Chen et al. |

FOREIGN PATENT DOCUMENTS

| | | |
|---|---|---|
| CN | 102470672 | 5/2012 |
| WO | WO-2015041665 | 3/2015 |

* cited by examiner

PRINTBARS AND METHODS OF FORMING PRINTBARS

CROSS-REFERENCE TO RELATED APPLICATIONS

The present divisional patent application continuation application claims priority under 35 USC § 120 from copending U.S. patent application Ser. No. 15/113,533 filed on Jul. 22, 2016 by Chien et al. and entitled PRINTBARS AND METHODS OF FORMING PRINTBARS, which claims priority under 35 USC § 119 from PCT/US2014/013317 filed on Jan. 28, 2014 by Chien et al. and entitled PRINTBARS AND METHODS OF FORMING PRINTBARS, the full disclosures both of which are hereby incorporate by reference.

BACKGROUND

Printing devices are widely used and may include a printhead die enabling formation of text or images on a print medium. Such a printhead die may be included in an inkjet pen or printbar that includes channels that carry ink. For instance, ink may distributed from an ink supply to the channels through passages in a structure that supports the printhead die(s) on the inkjet pen or printbar.

DETAILED DESCRIPTION

Printers that utilize a substrate wide printbar assembly have been developed to help increase printing speeds and reduce printing costs. Substrate wide printbar assemblies often tend to include multiple parts that carry printing fluid from the printing fluid supplies to the small printhead dies from which the printing fluid is ejected on to paper or other print substrate. It may be desirable to shrink the size of a printhead die. However, decreasing the size of a printhead die can involve changes to structures that support the printhead die, including passages that distribute ink to the printhead die. While reducing the size and spacing of the printhead dies continues to be associated with reducing cost, channeling printing fluid from supply components to tightly spaced dies may in turn lead to comparatively complex flow structures and fabrication processes that can actually increase an overall cost associated with a printhead die.

Forming such complex flow structures may itself involve use of difficult processes and/or additional materials such as carrier boards having prefabricated openings that extend through the carrier board. A prefabricated opening refers to an opening and/or combination of opening that alone or together extend through the carrier board and that are formed prior to printhead die attachment. Prefabricated openings can, for example, include windows, ink feed slots, etc. that extend through such a carrier board. Carrier boards having prefabricated openings may prove costly, ineffective, and/or difficult (time-consuming) to procure and/or utilize, among other shortcomings. For instance, such prefabricated openings may lead to reduced structure integrity (compared to use of solid carrier boards that are without prefabricated openings) and/or other difficulties, such as undesired migration of an adhesive material into a prefabricated opening.

In contrast, the printbars and methods of forming printbars, as described herein, include a printed circuit board (PCB), adhesive material, a printhead die sliver, and a slot extending through the PCB and the adhesive material (e.g., a portion of the adhesive material) to the printhead die sliver (e.g., to an ink feed hole included in the printhead die sliver). Advantageously, the printbars and methods of forming the printbars of the present disclosure do not include a prefabricated opening in the PCB. Moreover, the PCB can include a dam surrounding a perimeter of a recess included in the PCB. Such a recess and/or a dam can promote adhesive material placement, printhead die positioning (e.g., positioning such that a top surface of the printhead die sliver is co-planar with a top surface of the dam), and/or printhead die attachment to the PCB, among other advantages.

Figure 1:
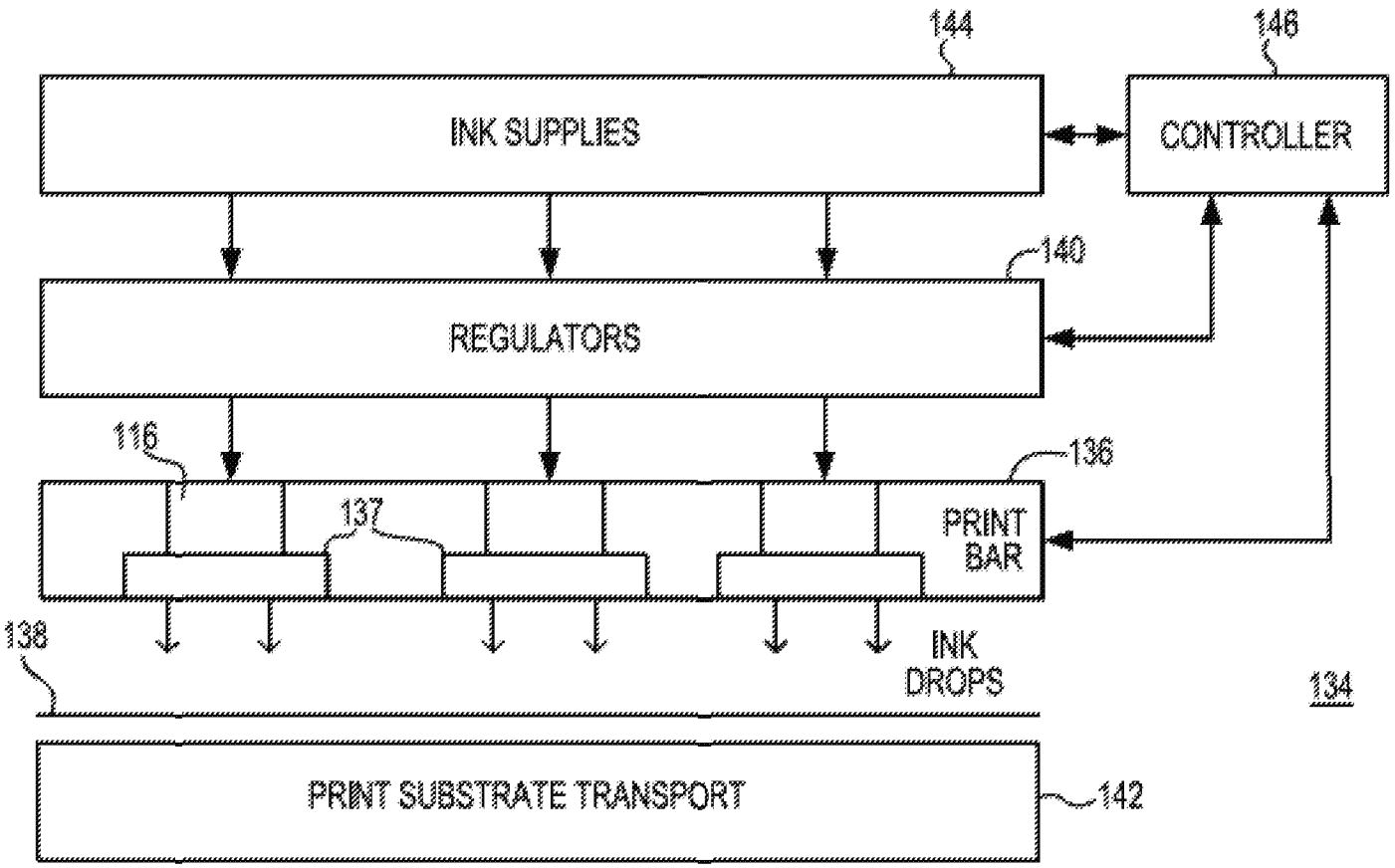
FIG. 1 is a block diagram illustrating a printer implementing an example of a printbar according to the present disclosure.

FIG. 1 is a block diagram illustrating a printer implementing an example of a printbar according to the present disclosure. Referring to FIG. 1, a printer 134 (e.g., an inkjet printer) includes a printbar 136 spanning the width of a print substrate 138, flow regulators 140 associated with the printbar 136, a substrate transport mechanism 142, ink or other printing fluid supplies 144, and a printer controller 146. The print controller 146 represents programming, processor(s) and associated memories, electronic circuitry, and/or other components to control operative elements (e.g., a printhead 137) of the printer 134.

Figure 5:
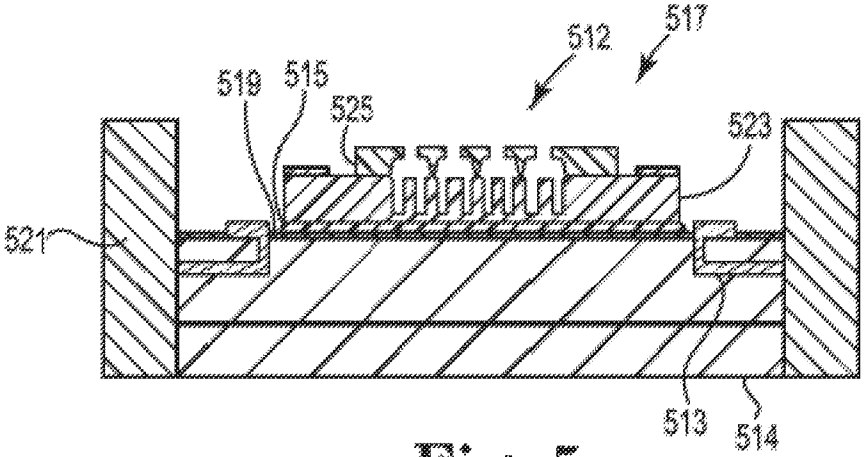
FIG. 5 is a section view illustrating an example of a stage subsequent to the stage illustrated in FIG. 4 in a process of forming the printbar according to the present disclosure.

The printbar 136 includes an arrangement of printheads 137 to dispense printing fluid on to a sheet or continuous web of paper or other print substrate 138. As described in detail below, each printhead 137 includes at least one printhead die sliver(s) 112 positioned in a recess (e.g., a recess 117 as illustrated in FIG. 5) of a PCB 114. In some examples, the die sliver(s) 112 can be positioned such that top surface(s) of the printhead die sliver(s) is co-planar with a top surface of a dam 121, as described herein.

The printhead die sliver 112 can be formed of semiconductor material (e.g., silicon) and can include integrated circuitry (e.g., transistors, resistors, etc.). Each printhead die sliver 112 includes ink feed holes, thin-film layer (including firing chambers), and conductors. A slot feeds printing fluid directly to the printhead die(s), such as to ink feed hole(s)

included in the printhead die sliver 112. The ink feed holes provide printing fluid (e.g., ink) to fluid ejectors formed in the thin-film layer. Each printhead die sliver 112 includes an ejection chamber and a corresponding orifice through which printing fluid is ejected from the ejection chamber.

Each printhead die 112 receives printing fluid through a flow path from the printing fluid supplies 144 into and through the flow regulators 140 and slot(s) 116 in printbar 136 to ink feed hole(s) (not shown) included in the printhead die sliver 112. Notably, as described herein, the slot 116 extends through a PCB 14 and an adhesive material to the printhead die sliver 112. That is, the slot 116 is not prefabricated and advantageously promotes printhead die sliver 112 positioning and/or printhead die sliver adhesion, among other advantages. For example, the printbars of the present disclosure enable adhesive material to be continuously applied to a recesses and/or adhesive material to be located on a bottom surface of a printhead die sliver 112 without encountering issues associated therewith, such as undesired adhesive material migration (e.g., migration into the slot 116). Additional advantages associated with the printbar 136 include that the printbar does not have a fluidic fan-out component between the printheads 137 and the fluid supply, among other advantages.

Figure 2:
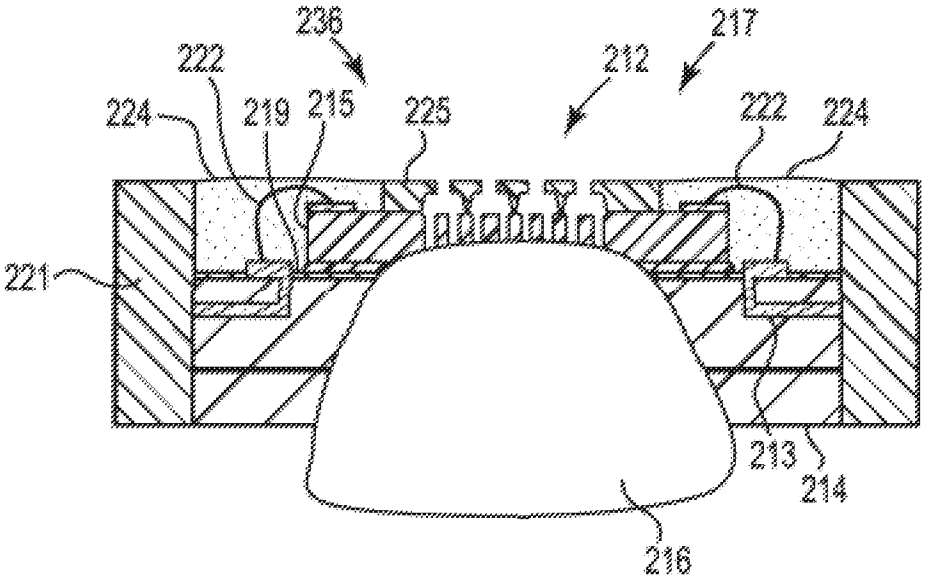
FIG. 2 is a section view illustrating an example of a printbar according to the present disclosure.
Figure 8:
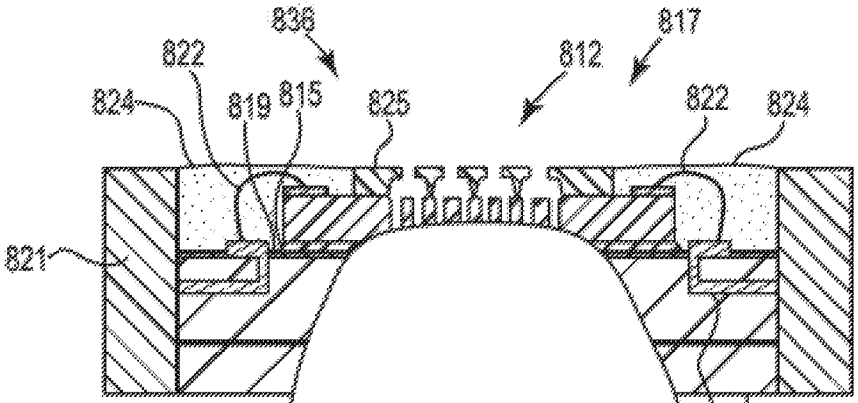
FIG. 8 is a section view illustrating an example of a stage subsequent to the stage illustrated in FIG. 7 in a process of forming the printbar according to the present disclosure.

FIG. 2 is a section view illustrating an example of a printbar module 236 according to the present disclosure. Such a printbar 236 can be used in printer 134 shown in FIG. 1, according to an example implementation. The printbar illustrated in FIG. 2 and FIG. 8 is single printbar module, for example, formed after completion of as the process described with respect to FIG. 11. The elements described with respect to FIG. 2 are analogous those described with respect to FIG. 3-8. In FIG. 2, and similarly in FIGS. 3-8, a portion of the dam 221 surrounding the recess 221 which would otherwise obscure the elements located behind the dam in the from the vantage of a section view has been purposefully omitted in an effort to clearly indicate the elements included in the Figures.

The printbar 236 includes a PCB 214. The PCB 214 refers to a cured epoxy composition having conductive elements 213 (e.g., conductive signal traces and/or bond pads) included therein that can include particulate matter and/or structures (e.g., fiberglass structures, etc.) embedded in the epoxy, such as FR4 board. The PCB 214 is a continuous solid, as opposed to carrier boards that include prefabricated openings.

Figure 3:
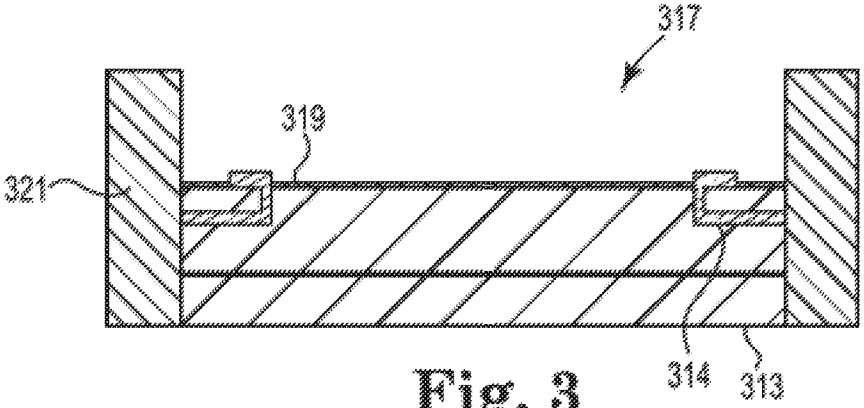
FIGS. 3 is a section view illustrating an example of a stage in a process of forming a printbar according to the present disclosure.

The PCB 214 includes a recess 217. The recess 217 extends partially into the PCB 214, for example, as illustrated in FIG. 3. In some examples, the recess 217 can be included in a plurality of recesses that each extends partially into the PCB 214. However, the recess 217 (or the plurality of recesses), alone or in combination with other geometric feature(s) in the PCB 214, does not extend through the PCB 214 (e.g., does not extend completely through a total depth of).

Formation of a recess 217 can include removal of a portion of the PCB 214 designated to become the recess and/or addition of material to the PCB 214 surrounding an area of the PCB designated to become the recess, among other methods of forming the recess. For example, a recess, such as recess 217, can be formed prior to die attachment by addition of material to the PCB 214, such as a dam 221. That is, in some examples, the PCB 214 includes a dam 221 surrounding a perimeter of the recess 217. The dam can, for example, be located as around (e.g., forming a perimeter) of an area of the PCB 214 designated to be the recess 217. Such added material can be the same or dissimilar to a material(s) include in the PCB 214 prior to adding the additional material. For example, the additional material can, in some examples, include an additional epoxy layer of the same or dissimilar epoxy included in PCB 214 on which the additional material is placed.

The recess 217 can include an adhesive material, such as adhesive material 215, on (e.g., disposed on) a bottom surface 219 of the recess 217. The adhesive material, such as adhesive material 215, refers to an epoxy, among other adhesive materials suitable to form the printbar modules, as described herein.

In some examples, the adhesive material can include a continuous adhesive material disposed on the bottom surface 219 of the recess 217. Such a continuous application may not be possible in PCB 14 having a prefabricated opening(s) as the adhesive material would undesirably migrate into the prefabricated opening(s). However, continuous application of the adhesive material in accordance with some examples of the present disclosure promotes die adhesion and/or provides mechanical stability of a resultant printbar module employing the same, among other advantages.

Figure 9:
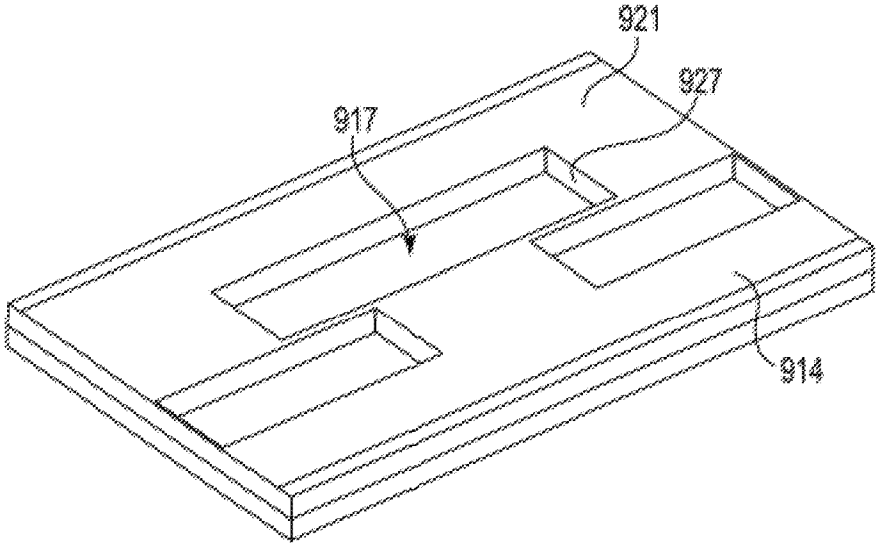
FIG. 9 is a plan view illustrating an example of a printbar according to the present disclosure.

While FIG. 2 illustrates the adhesive material 215 on the bottom surface 219 of the recess 217 the present disclosure is not so limited. Rather, the adhesive material 215 can, advantageously be located on the bottom surface 219 of the recess 217 and at least a portion of a side surface (e.g., side surface 523 as illustrated in FIG. 5) the printhead die sliver 212, among other locations to promote formation of the printbar modules 236. In some examples, the adhesive material 215 can include adhesive material disposed on a surface (e.g., side surface 927 as illustrated in FIG. 9) of the dam 221 surrounding the recess 217. Such application can promote at least a portion of a side surface of the printhead die sliver 212 having adhesive material 215 disposed therein, but is not vital to effectuate the same. The adhesive material 215 disposed on the surface of the dam 221 surrounding the recess 217 can be the same type of adhesive material 215 and/or can applied utilizing the same types of methods associated with applying adhesive material 215 to the bottom surface 219 of the PCB 214, as described herein.

The conductive elements 213 of the PCB 214 can be coupled, for example by wire bonds 222, to electrical circuits included in a printhead die structure (not shown), as described herein. Conductive elements 213 are analogous to conductive elements 313, 413, 513, 613, 713, and 813 as illustrated in FIG. 3, FIG. 4, FIG. 5, FIG. 6, FIG. 7, and FIG. 8, respectively, similar to the other elements of FIG. 2 and their respective analogous elements in FIGS. 3-8.

A molding 224 can encapsulate the wire bonds 222, the PCB 214, and/or the printhead die sliver 212. The molding 224 refers to a material that can protect the wire bonds 222, the PCB 214, and/or the printhead die sliver 212, such as an epoxy. Accordingly, such a molding can be applied and cured to protect the desired components. In some examples, the molding can be a monolithic molding compound, for instance, enabling multiple rows of printhead die slivers to be molded in a single, monolithic body on the PCB 214.

The PCB 214 includes a slot 216 form therein that extends through the PCB and an adhesive material 215 to the printhead die sliver 212. The slot 216 is not prefabricated and again advantageously promotes printhead die sliver 212 positioning and/or printhead die sliver adhesion, among other advantages. Formation of the slot is described in greater detail herein with respect to FIG. 8 and with respect to FIG. 11.

Figure 11:
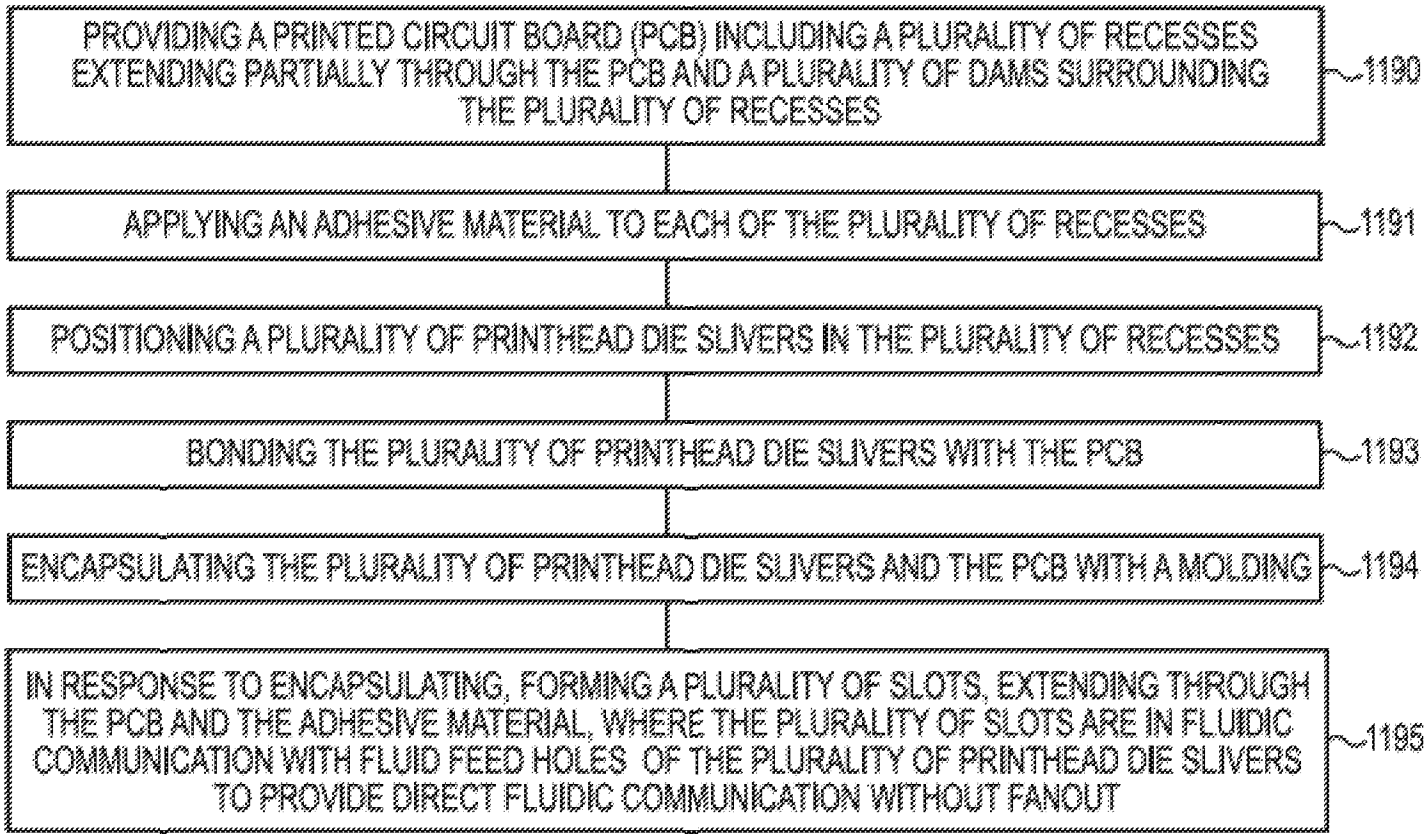
FIG. 11 is a flow diagram of an example of a process of forming a printbar according to the present disclosure.

FIGS. 3 is a section view illustrating an example of a stage in a process of forming a printbar according to the present disclosure, for example, after providing a PCB as described with respect to FIG. 11. The PCB 314 can include a plurality of recesses, such as recess 317, extending partially through the PCB and/or a plurality of dams, such as dam 321, surrounding the plurality of recesses (e.g., as illustrated in FIG. 9). The recess 317 can includes a bottom surface 319.

Figure 4:
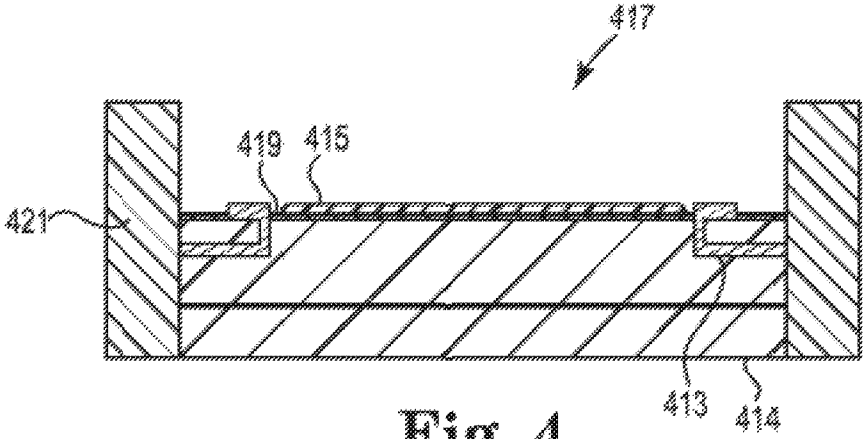
FIG. 4 is a section view illustrating an example of a stage subsequent to the stage illustrated in FIG. 3 in a process of forming the printbar according to the present disclosure.

FIG. 4 is a section view illustrating an example of a stage subsequent to the stage illustrated in FIG. 3 in a process of forming the printbar according to the present disclosure, for example, after applying an adhesive material to the PCB as described with respect to FIG. 11. In some examples, applying adhesive material 415 to the PCB 414 can include applying adhesive material 415 only to each of the plurality of recesses of the PCB. For example, adhesive material 415 can be applied only to a bottom surface 419 and/or side surfaces (e.g., side surface 27 as illustrated in FIG. 9) of a dam 21 that form edges of the recess 17.

FIG. 5 is a section view illustrating an example of a stage subsequent to the stage illustrated in FIG. 4 in a process of forming the printbar according to the present disclosure, for example, after positioning a die sliver in the recess as described with respect to FIG. 11. As illustrated in FIG. 5, printhead die sliver 512 can be positioned in an adhesive material 515 located on a bottom surface 519 of the recess having a dam 521 surrounding some/all of the recess. In some, examples the adhesive material can be applied to a side surface 523 of the printhead die sliver 512, as described herein.

Figure 6:
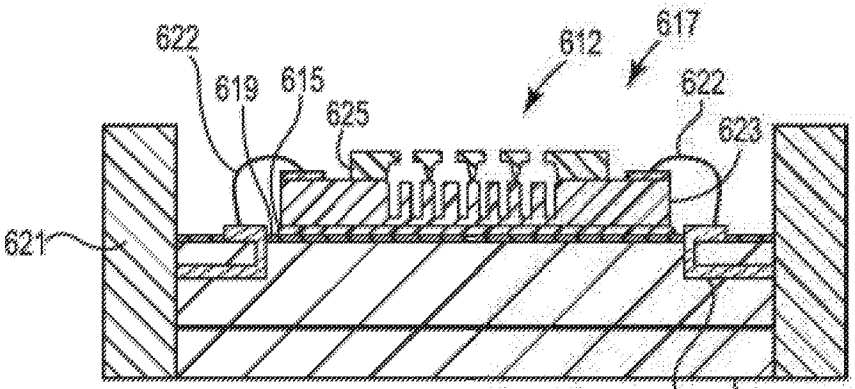
FIG. 6 is a section view illustrating an example of a stage subsequent to the stage illustrated in FIG. 5 in a process of forming the printbar according to the present disclosure.
Figure 7:
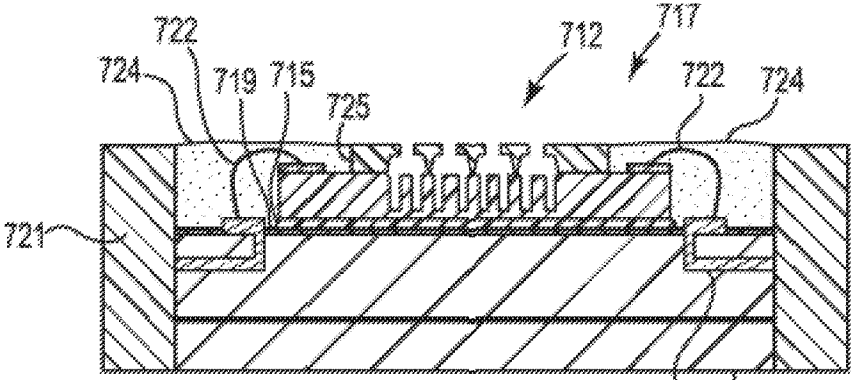
FIG. 7 is a section view illustrating an example of a stage subsequent to the stage illustrated in FIG. 6 in a process of forming the printbar according to the present disclosure.

FIG. 6 is a section view illustrating an example of a stage subsequent to the stage illustrated in FIG. 5 in a process of forming the printbar according to the present disclosure, for example, after bonding a die sliver with a PCB as described with respect to FIG. 11. Bonding, as described herein, can include forming wire bonds 622 coupling conductive elements of the PCB 614 to conductive elements (not shown) of the printhead die sliver 612. FIG. 7 is a section view illustrating an example of a stage subsequent to the stage illustrated in FIG. 6 in a process of forming the printbar according to the present disclosure, for example, after encapsulating a die sliver and/or a PCB with a molding as described with respect to FIG. 11. That is, molding 712 can, for example, encapsulate a printhead die sliver 712, wire bonds 722, and/or a PCB 714.

FIG. 8 is a section view illustrating an example of a stage subsequent to the stage illustrated in FIG. 7 in a process of forming the printbar according to the present disclosure, for example, after forming a slot extending through a PCB and an adhesive material (e.g., a portion of the adhesive material) to a printhead die sliver as described with respect to FIG. 11. Thus, while the formation of a single printhead die and slot, such as printhead die sliver 812 and slot 816, is shown in FIGS. 3-8, multiple printbar modules including multiple printhead die slivers and multiple slots can be formed, for example, as described with respect to FIG. 11. As illustrated in FIG. 8, a slot 816 can be formed through the PCB 814 and the adhesive material 815 such that the slot 816 is in fluidic communication with an ink feed hole 825 included in the printhead die sliver 812. The slot can be formed using various techniques, such as laser etching, plunge-cut saw, and the like FIG. 9 is a plan view illustrating an example of a printbar according to the present disclosure. PCB 914 can include a plurality of recesses including recess 917. The recesses can be arranged in an end in a staggered configuration, among other possible configurations. The recess can include side surfaces, such as side surface 927. That is, each of the recesses includes side surfaces, such as side surface 927. In some examples, an amount of adhesive material can be applied to a side surface 927 of dam 921. Side surface 927 can be flat, concave, or convex, among other possible shapes. An amount of adhesive material (not shown) sufficient to attach a side surface (e.g., side surface 523) of the printhead die to a side surface 927 of the dam 921 can, in some examples, be applied to the side surface 927. Advantageously, a resultant amount of adhesive material can be located between a side surface of the printhead die sliver and the side surface 927 of the dam 921 to promote printhead die sliver adhesion to a PCB 914 including the dam 921.

Figure 10:
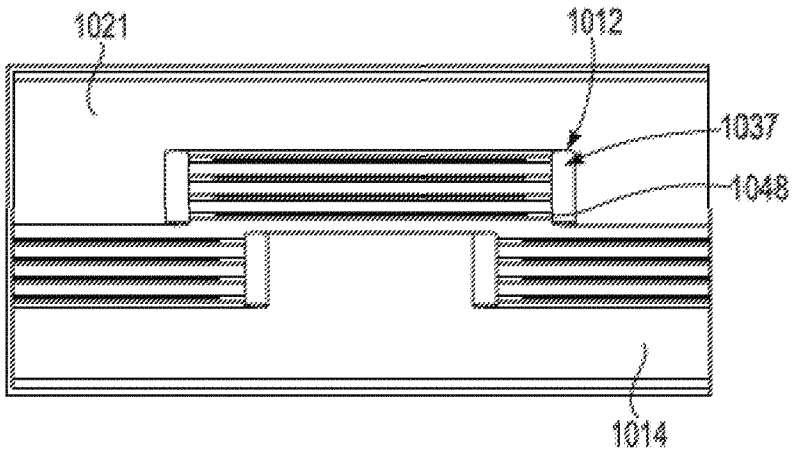
FIG. 10 is a plan view illustrating an example of a printbar according to the present disclosure.

FIG. 10 is a plan view illustrating an example of a printbar according to the present disclosure. Printheads 1037 in PCB 1014, as illustrated in FIG. 10 can be arranged in an end to end in rows 1048 in a staggered configuration in which the printheads in each row overlap another printhead in that row, among other possible configurations.

Referring to FIG. 10, in the example shown, each printhead 1037 can include a pair of printhead dies slivers 1012 each with two rows of ejection chambers (not shown) and corresponding orifices (not shown) through which printing fluid is ejected from the ejection chambers. Each slot form in the PCB 1014, as described herein, supplies printing fluid to one printhead die sliver 1012. However, other suitable configurations of printhead 1037 are possible. For example, more or fewer printhead dies 1012 may be used with more or fewer ejection chambers and/or slots.

Printing fluid flows into each ejection chamber from a manifold extending lengthwise along each printhead die, for example, between the two rows of ejection chambers. Printing fluid feeds into manifold through multiple ports that are connected to a slot at printhead die surface. Slot is substantially wider (at least twice as wide as) than printing fluid ports that carry printing fluid from larger, loosely spaced passages in and/or to the flow regulators or other parts that carry printing fluid into printbar to the smaller, tightly spaced printing fluid ports in printhead die. Thus, slot can help reduce or even eliminate a discrete "fan-out" and other fluid routing structures. That is, a separate fluidic fan-out structure is not included between the manifold and the printhead die slivers. In addition, exposing a substantial area of printhead die sliver surface (e.g., an ink feed hole) directly to slot allows printing fluid in slot to help cool printhead die sliver during printing.

An actual printhead die sliver is typically a complex integrated circuit (IC) structure formed on a silicon substrate (not shown) with layers and elements not shown in FIGS. 1-11. For example, a thermal ejector element or a piezoelectric ejector element (not shown) formed on the substrate at each ejection chamber (not shown) included in the printhead die sliver 12 is actuated to eject drops or streams of ink or other printing fluid from orifices (not shown).

While FIGS. 9 and 10 illustrate three staggered recesses, other suitable configurations are possible. For example, more or fewer printhead recesses may be used and/or the layout of the recesses may be altered. Similarly the shape, while illustrated as rectangular in nature, may be altered, for instance, depending upon the shape/size of a printhead die sliver and /or desired printbar module.

With regard to FIG. 10, although four rows 1048 of staggered printheads 1037 are shown, for printing four different colors for example, other suitable configurations are possible. For example, FIG. 10 shows a plan view of a printbar 1036 having staggered groups of printheads 1037 in the recesses of the PCB 14. Each of the groups includes four printheads 1037 by way of example, although a group can have more or less printheads.

FIG. 11 is a flow diagram of an example of a process of forming a printbar according to the present disclosure. As shown at 1190, the method can include providing a PCB including a plurality of recesses extending partially through the PCB and a plurality of dams surrounding the plurality of recesses. For example, providing can include forming the plurality of recesses and/or the plurality of dams in the PCB. However, the PCB can include prefabricated recesses and/or dams. For example, a PCB including prefabricated recesses extending partially through the PCB and/or dams surrounding at least a portion of the recesses can be provided. Such a PCB, recesses, and/or dams can be analogous to the PCB as described with respect to FIGS. 1-10.

Adhesive material can be applied to the PCB. For instance, the method can include applying an adhesive material to each of the plurality of recesses, as shown at 1191. Examples of the adhesive material include a flowable thermoset epoxy, among other adhesive materials suitable for application and printhead modules, as described herein. The adhesive material is applied to provide permanent adhesion of the die slivers to the PCB, as opposed to temporary adhesive material(s)/temporary adhesive products, for instance, temporary adhesion associated with thermal release tape and/or ultraviolet release tape, among other temporary adhesives materials and/or products utilizing temporary adhesive materials.

In some examples, the adhesive material is applied on both a bottom surface of the recess and/or side surfaces of a dam (e.g., surfaces of the adhesive material in contact with a side surface of the dam), such that, the adhesive material can attach a printhead die sliver to the PCB. For example, the adhesive material can be applied (e.g., continuously applied) to a bottom surface of each of the plurality of recesses and/or applied to a side surface (e.g., side surface as illustrated in FIG. 9) of the dam adjacent the plurality of recesses. In some examples, an amount of adhesive material sufficient to enable the adhesive material to attach to a side surface of the printhead die and/or a side surface of the dam can be applied.

The adhesive material can be applied to the plurality of recesses and/or applied to a side surfaces of the dam using various techniques such as adhesive material stamping, stencil printing, and/or pin transfer, among other suitable techniques to apply the adhesive material as described herein. In some examples, applying adhesive material to the PCB includes applying adhesive material only to each of the plurality of recesses of the PCB. Such limited application can promote die positioning and/or provide a comparative reduction in cost associated with adhesive application (e.g., compared to coating the entire PCB), among other advantages. The adhesive material can be applied in a thickness and/or pattern suitable to promote positioning of the printhead die slivers.

For example, the method can include positioning a plurality of printhead die slivers in the plurality of recesses, as illustrated at 1192. Positioning can, in some examples, positioning the plurality of printhead die slivers within an adhesive material, such as adhesive material applied at 1191. The plurality of die slivers can be positioned with an orifice side facing down (towards a bottom surface of a recess) in the plurality of recesses. One of more of the plurality of die slivers can be positioned with each of the plurality of recesses. In some examples, a single die sliver of the plurality of die slivers is positioned within a single recess of the plurality of recesses. In this manner, a total number of the die slivers positioned in the recesses can equal a total number of the plurality of recesses. However, other positioning arrangements and/or total number of the plurality of printhead die slivers relative to a total number of the plurality of recesses are possible depending upon a desired type/performance of a resultant printbar module.

As illustrated at 1193 the method can include bonding the plurality of printhead die slivers with the PCB. For instance, the plurality of printhead die slivers positioned in the plurality of recesses, as illustrated at 1192, can be bonded to the PCB. Bonding can, in some examples, include wire bonds coupling conductive elements, such as conductive elements, of the PCB to conductive elements of the printhead die slivers. Wire bonds can include gold and/or copper bonds, among other suitable materials for forming wire bonds, for example, ball bond or wedge bonds coupling conductive elements of the PCB to conductive elements of the printhead die slivers.

The method can include encapsulating the plurality of printhead die slivers and/or the PCB with a molding, as illustrated at 1194. The mold can partially and/or completely encapsulate the plurality of printhead die slivers. For example, the plurality of printhead die slivers and/or the PCB can be encapsulated with a molding in response to bonding the plurality of printhead die slivers with the PCB. Encapsulating can include dispensing a liquid encapsulate material (e.g., an epoxy and/or an epoxy-based encapsulate material) over the printhead die slivers and/or and the wire bonds. In some examples, encapsulating can planarize the printhead die sliver, for instance, making a top surface of the printhead die sliver (e.g., a top surface of the molding located above a top surface of the printhead die sliver) co-planar with a top surface of a dam.

In response to encapsulating, for example, such as described with respect to 1194, the method can include forming a plurality of slots, extending through the PCB and the adhesive material, as illustrated at 1195. That is, the plurality of slots is formed after completion of encapsulating, as described herein. In various examples, encapsulating can include where the plurality of slots are in fluidic communication with fluid (e.g., ink) feed holes of the plurality of printhead die slivers to provide direct fluidic communication without fan-out, as described herein.

The adhesive material can remain on the bottom surface of the recess and a bottom surface of each of the plurality of printhead die slivers and/or between a side surface of the plurality of die slivers and a side surface(s) of a dam(s), such as dam. For instance, in some examples, forming can include forming the plurality of slots such that a portion of the adhesive material remains between the bottom surface 19 of the recess and a bottom surface of each of the plurality of printhead die slivers.

In some examples, forming includes forming the plurality of slots using a plunge-cut saw. However, the present disclosure is not so limited. That is, forming the plurality of slots, analogous or similar to slot 16, as described herein, can employ suitable chemical (e.g., chemical etching, etc.) and/or mechanical (e.g., drill, sand-blasting, laser, etc.) methods to form the plurality of slots.

The plurality of die slivers including printhead die sliver are not part of a single semiconductor substrate, but rather are formed from separate semiconductor substrates (note that the plurality of slivers can be formed on a single PCB and then singulated during manufacture to be assembled as part of printer). For example, the separate printhead die slivers can be positioned to provide an appropriate ink slot pitch that cooperates with a manifold (not shown) to receive the ink.

In an example, a width of each die sliver can be substantially narrower than a spacing between die slivers. Further, the thickness of each die sliver can be substantially thinner than a thickness of the PCB and/or a molding. In a non-limiting example, each die sliver is less than or equal to 300 micrometers. It is to be understood that the die slivers can have other thickness more than 300 micrometers.

As used in this document, a "micro device" means a device having at least one exterior dimensions less than or equal to 30 mm; "thin" means a thickness less than or equal to 650 μm; a "sliver" means a thin micro device having a ratio of length to width (L/W) of at least three; a "printhead" and a "printhead die" mean that part of an inkjet printer or other inkjet type dispenser that dispenses fluid from at least one openings. A printhead includes at least one printhead dies. "Printhead" and "printhead die sliver" are not limited to printing with ink and other printing fluids but also include inkjet type dispensing of other fluids and/or for uses other than printing. The terms "printbar" and "printbar module" as used herein is meant to encompass various print structures, such as page-wide modules, integrated printhead/containers, individual ink cartridges, and the like. While the present disclosures describes "ink" by way of example, it is to be understood that "fluid" can be used in place of "ink" wherever "ink" is specifically recited.

The specification examples provide a description of the applications and use of the system and method of the present disclosure. Since many examples can be made without departing from the spirit and scope of the system and method of the present disclosure, this specification sets forth some of the many possible example configurations and implementations. With regard to the figures, the same part numbers designate the same or similar parts throughout the figures. The figures are not necessarily to scale. The relative size of some parts is exaggerated to more clearly illustrate the example shown.

What is claimed:

1. A method of forming a printbar module, comprising:

providing a solid printed circuit board (PCB) that does not include an opening extending through the PCB, wherein the PCB includes a recess extending partially into the PCB but not through the PCB and a dam surrounding the recess;

applying an adhesive material to the recess;

positioning a printhead die sliver in the recess;

bonding the printhead die sliver with the PCB with an adhesive material disposed on a bottom surface of the recess;

encapsulating the printhead die sliver and the PCB with a molding; and in response to encapsulating, forming a slot extending through the PCB and a portion of the adhesive material to the printhead die sliver, wherein the slot is in fluidic communication with a fluid feed hole of the printhead die sliver to provide direct fluidic communication without fan-out.

2. The method of claim 1, wherein forming includes forming the slot using a plunge-cut saw.

3. The method of claim 1, wherein bonding includes wire bonds coupling conductive elements of the PCB to conductive elements of the printhead die sliver.

4. The method of claim 1, wherein applying the adhesive material to the PCB includes applying adhesive material only to the recess of the PCB.

5. The method of claim 1, wherein forming includes forming the slot such that a portion of the adhesive material remains between a bottom surface of the recess and a bottom surface of the printhead die sliver.

6. The method of claim 1, wherein the printhead die sliver has a bottom surface facing a floor of the recess, a top surface, a first fluid channel and a second fluid channel and wherein the slot is formed so as to have a floor facing away from the top surface of the printhead die sliver, the floor of the slot having a portion extending from the first fluid channel to the second fluid channel, the portion being located between the bottom surface and the top surface, beyond the bottom surface.

7. The method of claim 1, wherein a top surface of the printhead die sliver is co-planar with a top surface of the dam.

8. The method of claim 1, wherein the PCB comprises fiberglass structures embedded in an epoxy.

9. The method of claim 1, wherein the PCB comprises an electrically conductive element extending on a floor of the recess.

10. The method of claim 9, wherein the electrically conductive element has a first portion below the floor of the recess and a second portion on the floor of the recess and electrically connected to the first portion.

11. The method of claim 9 further comprising a molding compound within the recess and covering the electrically conductive element.

12. The method of claim 9 further comprising a wire bond connecting the electrically conductive element and the printhead die sliver, the wire bond located within the recess between side surfaces of the dam.

13. The method of claim 12 further comprising a molding compound within the recess and encapsulating the wire bond.

14. The method of claim 1, wherein the slot is formed so as to extend partially into the printhead die sliver.

15. The method of claim 1, wherein the PCB comprises a first layer of material forming a floor of the recess and a second layer of material forming the dam and sides of the recess.

16. The method of claim 11, wherein the printhead die sliver has a sliver surface facing away from a floor of the recess and wherein the molding compound has a surface flush with the sliver surface of the printhead die sliver.

17. The method of claim 16, wherein the printhead die sliver has a second sliver surface facing away from the floor of the recess, the second sliver surface extending within the recess and wherein the molding compound covers the second sliver surface with the second sliver surface being sandwiched between the molding compound and the floor of the recess.

18. The method of claim 17, wherein the printhead die sliver comprises electrical contact pads on the second sliver surface, the electrical contact pads being within the recess and wherein the molding compound covers the electrical contact pads.

19. The method of claim 1, wherein the recess extends into a first face of the PCB and wherein the slot extends into a second face of the PCB, the second face being opposite the first face.

20. The method of claim 6, wherein the first fluid channel and the second fluid channel each extend towards the bottom surface of the printhead die sliver, being connected to the slot between the top surface of the printhead die sliver and the bottom surface of the printhead die sliver.

* * * * *